US007738830B2

(12) United States Patent
Isamikawa et al.

(10) Patent No.: US 7,738,830 B2
(45) Date of Patent: Jun. 15, 2010

(54) IMAGE FORMING APPARATUS, IMAGE FORMING SYSTEM AND COMPUTER PROGRAM OF THE SAME FOR FORMING COVER SHEET

(75) Inventors: Junichi Isamikawa, Hachioji (JP); Michio Osada, Fussa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 952 days.

(21) Appl. No.: 11/516,125

(22) Filed: Sep. 6, 2006

(65) Prior Publication Data

US 2007/0170632 A1 Jul. 26, 2007

(30) Foreign Application Priority Data

Jan. 24, 2006 (JP) ..... 2006-014803

(51) Int. Cl.
*G03G 15/00* (2006.01)
*B42D 3/00* (2006.01)

(52) U.S. Cl. ..... 399/408; 270/58.08; 412/4; 412/9

(58) Field of Classification Search ..... 399/81, 399/362, 382, 407, 408, 409; 355/25; 270/52.02, 270/58.04, 58.05, 58.08, 58.09; 412/4, 19; 281/21.1, 29

See application file for complete search history.

(56) References Cited

U.S. PATENT DOCUMENTS 5,724,075 A * 3/1998 Smith ..... 347/2
5,735,659 A * 4/1998 Kosasa et al. ..... 412/9
5,832,193 A * 11/1998 Perine et al. ..... 358/1.18
6,097,916 A * 8/2000 Asai ..... 399/182
6,416,082 B1 * 7/2002 Gayoso ..... 281/29
6,572,318 B2 * 6/2003 Cobene et al. ..... 412/11
6,801,750 B2 * 10/2004 Kawahira ..... 399/407
7,263,328 B2 * 8/2007 Asai et al. ..... 399/408
7,319,539 B2 * 1/2008 Yamamura ..... 358/1.15
7,448,650 B2 * 11/2008 Hengsbach ..... 281/29
7,454,163 B2 * 11/2008 Kasahara et al. ..... 399/408
7,603,074 B2 * 10/2009 Yamaguchi ..... 399/408
2006/0279812 A1 * 12/2006 Shiba ..... 358/532
2007/0172284 A1 * 7/2007 Tsukamoto ..... 400/76
2008/0240887 A1 * 10/2008 Gotoh et al. ..... 412/4

FOREIGN PATENT DOCUMENTS

JP 2000-332987 A 11/2000
JP 2005338416 A * 12/2005

* cited by examiner

*Primary Examiner*—Robert Beatty
(74) *Attorney, Agent, or Firm*—Frishauf, Holtz, Goodman & Chick, P.C.

(57) ABSTRACT

There is described an image forming apparatus, which makes it possible to form a lining cover sheet image at an appropriate position of the lining cover sheet, irrespective of change of the lining cover sheet width. The apparatus includes a lining cover-sheet width acquiring section to acquire a lining cover-sheet width; a cover-sheet image data acquiring section to acquire various cover-sheet image data sets; a cover-sheet image data arranging section to arrange the front cover-sheet image data and the rear cover-sheet image data in such a manner that they are arranged at an interval of the lining cover-sheet width, and to arrange the lining cover-sheet image data in such a manner that a lining image center line coincides with a cover sheet center line, in its width direction; and an image forming section to form the total cover sheet image, based on the arranged image data.

16 Claims, 6 Drawing Sheets

IMAGE FORMING APPARATUS, IMAGE FORMING SYSTEM AND COMPUTER PROGRAM OF THE SAME FOR FORMING COVER SHEET

This application is based on Japanese Patent Application No. 2006-014803 filed on Jan. 24, 2006 in Japanese Patent Office, the entire content of which is hereby incorporated by reference.

BACKGROUND OF THE INVENTION

The present invention relates to an image forming apparatus, an image forming system and a computer program of the same.

There has been well known the book-binding technology for creating a booklet in which a bunch of recording papers to be contents of the booklet (hereinafter, the term of the abovementioned "recording papers" is referred to as "main content sheets") is covered by a cover sheet in such a manner that the main content sheets are enveloped by the cover sheet while one side, upper and lower sides of the bunch of the main content sheets are made to be open. In addition, there has been also well known the image forming apparatus that produces such the cover sheet on which a front cover image, a back cover image and a lining cover image are formed so as to provide the cover sheet mentioned in the above.

For instance, Patent Document 1 (Tokkai 2000-332987, Japanese Non-Examined Patent Publication) set forth the method for determining the reading width of the lining cover document by setting the width of the lining cover when reading the lining cover document, and reading the lining cover document.

The width of lining cover should be determined, based on the thickness of the bunch of the main content sheets. However, if the thickness of the bunch of the main content sheets is different from the value presumed in advance, it is necessary to change the width of the lining cover to new one.

According to the Patent Document 1, in the case mentioned in the above, the setting value of the width of the lining cover should be changed. However, since the reading width of the lining cover document becomes different from that established in advance due to the width change mentioned in the above, the lining cover image would be formed at a position shifted from the center of the lining cover sheet in its width direction when reading the lining cover document, which was initially prepared so as to position the image at the center of the lining cover sheet in its width direction, as it is. Accordingly, it has been a problem that it should be necessary to generate a new lining cover document in which the center of the image coincided with that of the lining cover sheet in its width direction based on the changed width of the lining cover sheet.

SUMMARY OF THE INVENTION

To overcome the abovementioned drawbacks in conventional image-recording apparatus, it is an object of the present invention to provide an image forming apparatus, which makes it possible to form a lining cover sheet image at an appropriate position of the lining cover sheet, irrespective of change of the lining cover sheet width.

Accordingly, to overcome the cited shortcomings, the abovementioned object of the present invention can be attained by an image forming apparatus, an image forming system and a computer program, described as follow.

(1) An image forming apparatus, comprising: a lining cover-sheet width acquiring section to acquire information with respect to a lining cover-sheet width; a cover-sheet image data acquiring section to acquire front cover-sheet image data, rear cover-sheet image data and lining cover-sheet image data; a cover-sheet image data arranging section to arrange the front cover-sheet image data and the rear cover-sheet image data, acquired by the cover-sheet image data acquiring section, in such a manner that a front cover sheet image and a rear cover sheet image are arranged at an interval of the lining cover-sheet width, acquired by the lining cover-sheet width acquiring section, and to arrange the lining cover-sheet image data, acquired by the cover-sheet image data acquiring section, in such a manner that a lining image center line, indicating a center position of an image area of a lining cover sheet image in its width direction, coincides with a cover sheet center line, indicating a center position of an image area of a total cover sheet image, including the front cover sheet image, the rear cover sheet image and the lining cover sheet image, in its width direction; and an image forming section to form the total cover sheet image, including the front cover sheet image, the rear cover sheet image and the lining cover sheet image, onto a recording medium, based on the front cover-sheet image data, the rear cover-sheet image data and the lining cover-sheet image data, which are arranged by the cover-sheet image data arranging section.

(2) An image forming system, comprising:

an image forming apparatus that includes: a lining cover-sheet width acquiring section to acquire information with respect to a lining cover-sheet width; a cover-sheet image data acquiring section to acquire front cover-sheet image data, rear cover-sheet image data and lining cover-sheet image data; a cover-sheet image data arranging section to arrange the front cover-sheet image data and the rear cover-sheet image data, acquired by the cover-sheet image data acquiring section, in such a manner that a front cover sheet image and a rear cover sheet image are arranged at an interval of the lining cover-sheet width, acquired by the lining cover-sheet width acquiring section, and to arrange the lining cover-sheet image data, acquired by the cover-sheet image data acquiring section, in such a manner that a lining image center line, indicating a center position of an image area of a lining cover sheet image in its width direction, coincides with a cover sheet center line, indicating a center position of an image area of a total cover sheet image, including the front cover sheet image, the rear cover sheet image and the lining cover sheet image, in its width direction; and an image forming section to form the total cover sheet image, including the front cover sheet image, the rear cover sheet image and the lining cover sheet image, onto a recording medium, based on the front cover-sheet image data, the rear cover-sheet image data and the lining cover-sheet image data, which are arranged by the cover-sheet image data arranging section; and a book binding apparatus that joins the recording medium, on which the total cover sheet image is formed by the image forming apparatus, to a bunch of paper sheets, in such a manner that the bunch of paper sheets is enveloped by the recording medium while one side, upper and lower sides of the bunch of paper sheets are made to be open.

(3) A product for storing computer program, the computer program comprising: a lining cover-sheet width acquiring step for acquiring information with respect to a lining cover-sheet width; a cover-sheet image data acquiring step for acquiring front cover-sheet image data, rear cover-sheet image data and lining cover-sheet image data; a cover-sheet image data arranging step for arranging the front cover-sheet image data and the rear cover-sheet image data, acquired in the cover-sheet image data acquiring step, in such a manner that a front cover sheet image and a rear cover sheet image are arranged at an interval of the lining cover-sheet width, acquired in the lining cover-sheet width acquiring step, and for arranging the lining cover-sheet image data, acquired in the cover-sheet image data acquiring step, in such a manner that a lining image center line, indicating a center position of an image area of a lining cover sheet image in its width direction, coincides with a cover sheet center line, indicating a center position of an image area of a total cover sheet image, including the front cover sheet image, the rear cover sheet image and the lining cover sheet image, in its width direction; and an image forming step for forming the total cover sheet image, including the front cover sheet image, the rear cover sheet image and the lining cover sheet image, onto a recording medium, based on the front cover-sheet image data, the rear cover-sheet image data and the lining cover-sheet image data, which are arranged in the cover-sheet image data arranging step.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Configuration of Apparatus

Figure 1:
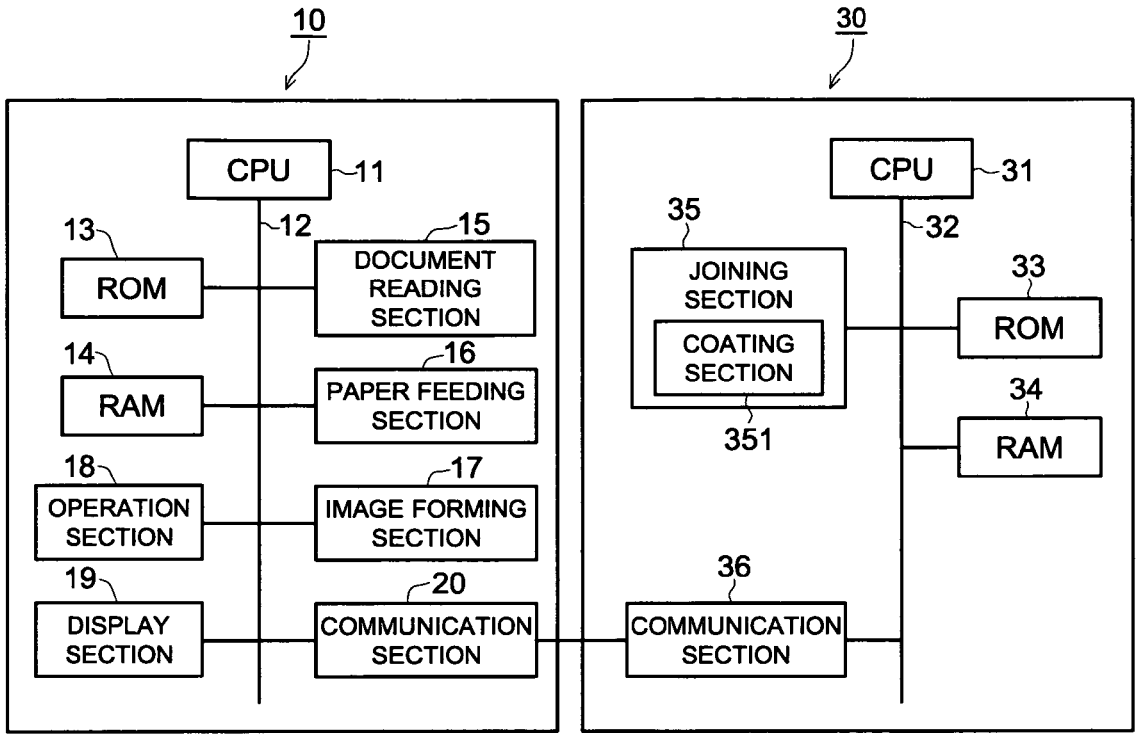
FIG. 1 shows a block diagram of an image forming system embodied in the present invention.

FIG. 1 shows a block diagram of the image forming system embodied in the present invention. As shown in FIG. 1, in the image forming system, an image forming apparatus 10 and a sizing case binding apparatus 30 are coupled to each other.

The image forming apparatus 10 is provided with a CPU (Central Processing Unit) 11 for executing various kinds of controlling operations according to programs, a ROM (Read Only Memory) 13, a RAM (Random Access Memory) 14, a document reading section 15, a paper feeding section 16, an image forming section 17, an operation section 18, a display section 19 and a communication section 20, which are coupled to each other through a bus 12.

The ROM 13 stores various kinds of the programs and the data based on which the CPU 11 implements the operations for controlling the image forming apparatus 10.

The CPU 11 utilizes the RAM 14 as a working area in which the programs and the data necessary for implementing the controlling operations are temporarily stored.

The document reading section 15 reads document images of a front cover, main content sheets, a back cover and a lining cover in order to generate image data of them. The CPU 11 applies image processing operations to the generated image data, and then, outputs the processed image data to the image forming section 17.

The paper feeding section 16 accommodates cover sheets and main content sheets, and feeds a cover sheet or a main content sheet into the image forming section 17.

The image forming section 17 forms images onto the cover sheet or the main content sheets, based on the image data inputted from the document reading section 15.

The operation section 18 is operated by the user so as to input the width of the lining cover, a print commencement instruction, etc.

The display section 19 displays setting screens, such as a lining cover width-setting screen, etc. Further, it is also applicable that the touch panel is equipped on the display screen of the display section 19 so as to simultaneously serve as the operation section 18.

The communication section 20 serves as an interface for communicating with the external devices to receive the image data transmitted from the personal computer, etc.

The sizing case binding apparatus 30 is provided with a CPU (Central Processing Unit) 31 for executing various kinds of controlling operations according to programs, a ROM (Read Only Memory) 33, a RAM (Random Access Memory) 34, a joining section 35 serving as an adhesive bonding section, and a communicating section 36, which are coupled to each other through a bus 32.

The ROM 33 stores various kinds of the programs and the data based on which the CPU 31 implements the operations for controlling the sizing case binding apparatus 30.

The CPU 31 utilizes the RAM 34 as a working area in which the programs and the data necessary for implementing the controlling operations are temporarily stored.

The joining section 35 has a coating section 351 for coating a bonding adhesive onto the lining area of the bunch of the main content sheets ejected from the image forming apparatus 10, so as to join the cover sheet, on which the cover sheet images are formed by the image forming apparatus 10, and the lining area together with the bonding adhesive.

The communication section 36 is coupled to the image forming apparatus 10 to transmit the various kinds of data between the communicating section 36 and the image forming apparatus 10.

Figure 2:
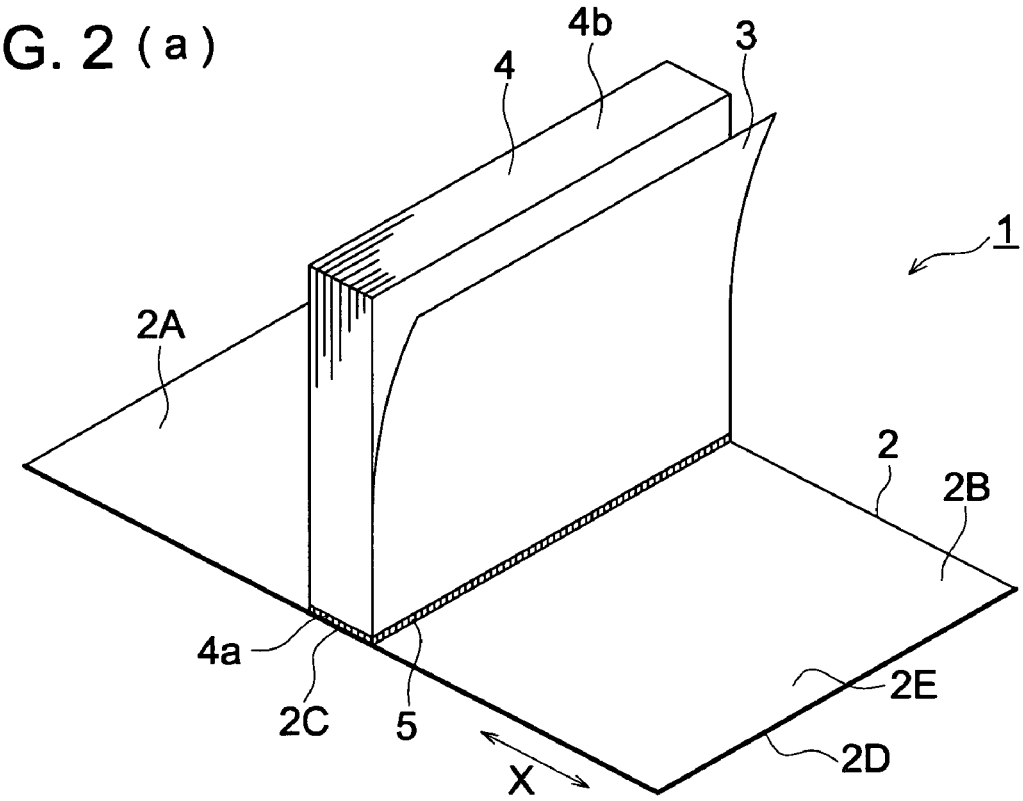
FIG. 2 shows an explanatory drawing for explaining a booklet formed through a case binding process.
Figure 2:
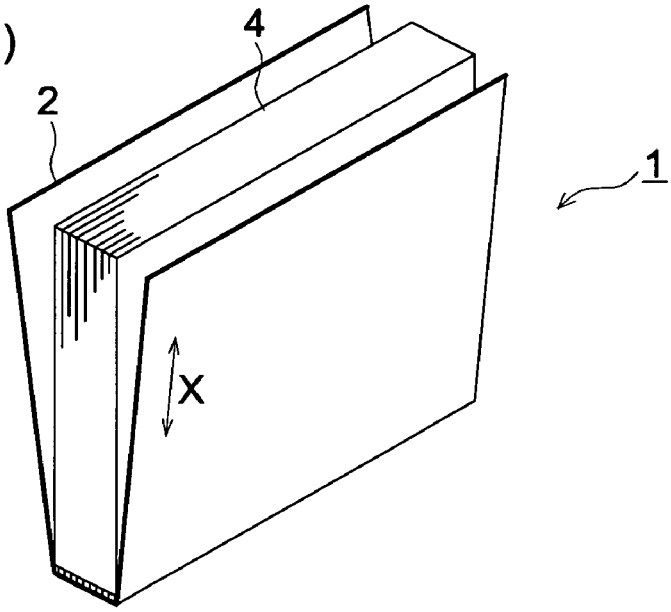

FIG. 2 shows an explanatory drawing for explaining a booklet formed through the case binding process. A booklet 1, formed by employing the case binding method, includes a cover sheet 2 shaped in a rectangular envelope case and paper sheets 3 (also referred to as the main content sheets). The cover sheet 2 and a lining section 4*a* of a bunch of paper sheets 4 are joined together with a bonding adhesive 5. Numeral 2A indicates a front cover sheet of the booklet 1, numeral 2B indicates a back cover sheet of the booklet 1, numeral 2C indicates a lining cover sheet of the booklet 1, numeral 2D indicates a front surface of the cover sheet 2 of the booklet 1, and numeral 2E indicates a rear surface of the cover sheet 2 of the booklet 1. Incidentally, the rear surface 2E indicates the surface of the cover sheet 2 to which the lining area of the bunch of paper sheets 4 is joined so as to form the booklet 1, while the front surface 2D indicates the surface opposite to the rear surface 2E, namely indicates the outer surface of the booklet 1.

<Brief Explanation of Cover Sheet Image-Forming Operation>

Figure 3:
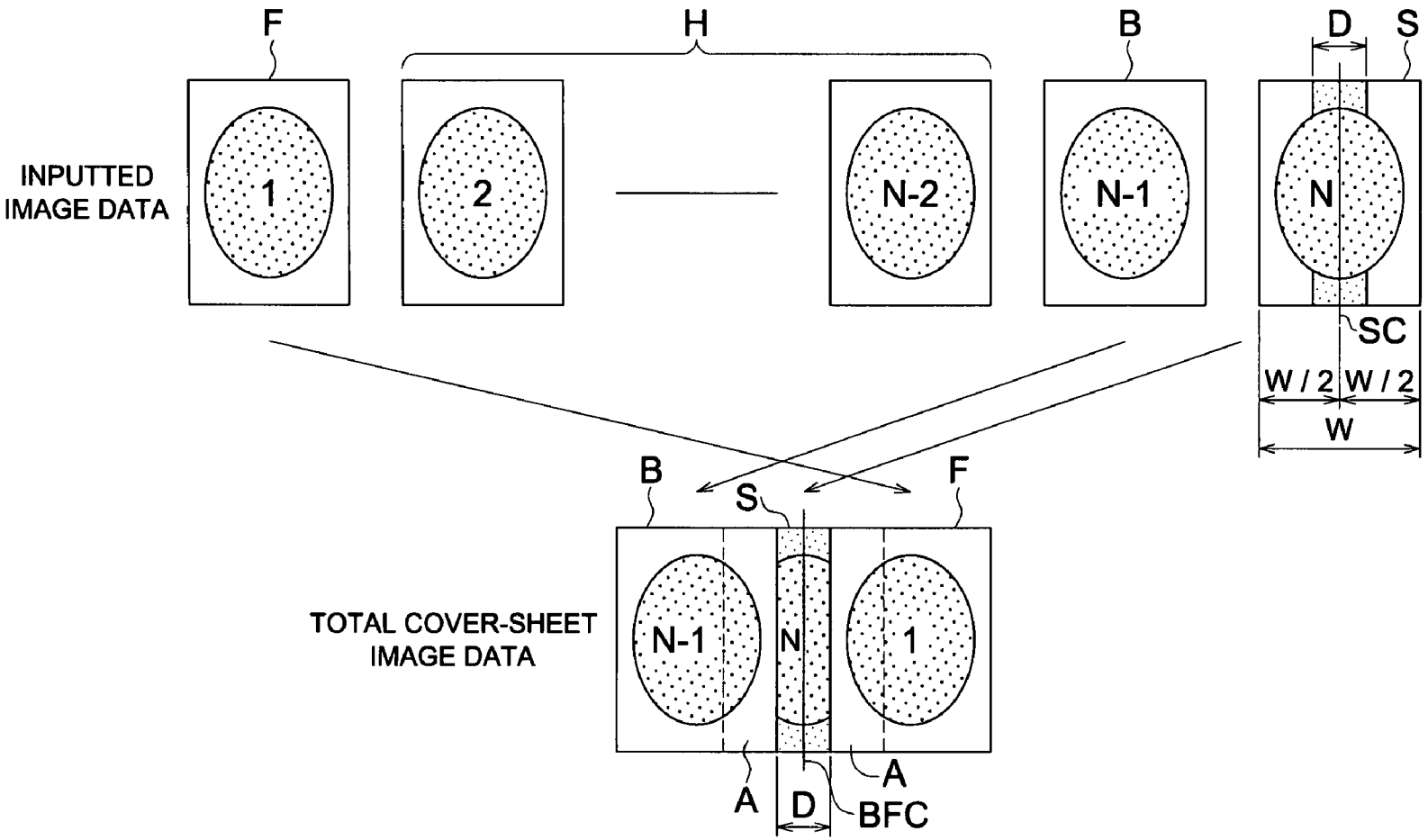
FIG. 3 shows an example of an image forming operation when forming images onto one side surface of a cover sheet.

FIG. 3 shows an example of the image forming operation when forming images onto one side surface of the cover sheet 2. As shown in FIG. 3. Page 1, Page 2-Page (N-2), Page (N-1) and Page N correspond to front cover-sheet image data F, main-content sheets image data H, rear cover-sheet image data B and lining cover-sheet image data S, respectively. The abovementioned image data sets F, H, B, S can be acquired by reading document images of the front cover sheet, the main content sheets, the back cover sheet and the lining cover sheet, which are set on the document reading section 15 in a state of overlapping them in the above order. Incidentally, the size of the document image for the lining cover sheet is the same as those of the main content sheets, the back cover sheet and the lining cover sheet. Accordingly, the data size of the lining cover-sheet image data S, acquired by reading the document image for the lining cover sheet, is also the same as those of the front cover-sheet image data F, the main-content sheets image data H and the rear cover-sheet image data B.

As shown in FIG. 3, the total cover-sheet image data, based on which the cover sheet images are formed on the cover sheet 2, can be obtained by combining the rear cover-sheet image data B for Page (N-1), the lining cover-sheet image data S for Page N and the front cover-sheet image data F for Page 1 with each other while arraying them in the above order.

When combining the rear cover-sheet image data B, the lining cover-sheet image data S and the front cover-sheet image data F with each other, the rear cover-sheet image data B and the front cover-sheet image data F are disposed at an interval of a lining sheet width D established by the operation section 18, and at the same time, the lining cover-sheet image data S are disposed at such a position that a central line SC of the lining cover-sheet image data S coincides with a central line BFC of the rear cover-sheet image data B and the front cover-sheet image data F, which are disposed in the width direction. Further, an overlapping area A of the lining cover-sheet image data S in the total cover-sheet image data shown in FIG. 3, at which the lining cover-sheet image data S overlap with the rear cover-sheet image data B or the front cover-sheet image data F, are made to be invalid.

Incidentally, the width direction is defined as the X-direction shown in FIG. 2, namely, a direction directed towards a edge portion 4*b* from the lining section 4*a* of the bunch of the main content sheets shaped in the booklet.

To make the image data, corresponding to the overlapping area A of the lining cover-sheet image data S, invalid, various kinds of methods, such as a method for recognizing the overlapping area A so as to make the image data corresponding to the overlapping area A of the lining cover-sheet image data S invalid, a method for recognizing an area corresponding to the lining sheet width D within the lining cover-sheet image data S in order to extract image data of an area other than that corresponding to the lining sheet width D within the lining cover-sheet image data S, etc., can be employed as needed.

Figure 4:
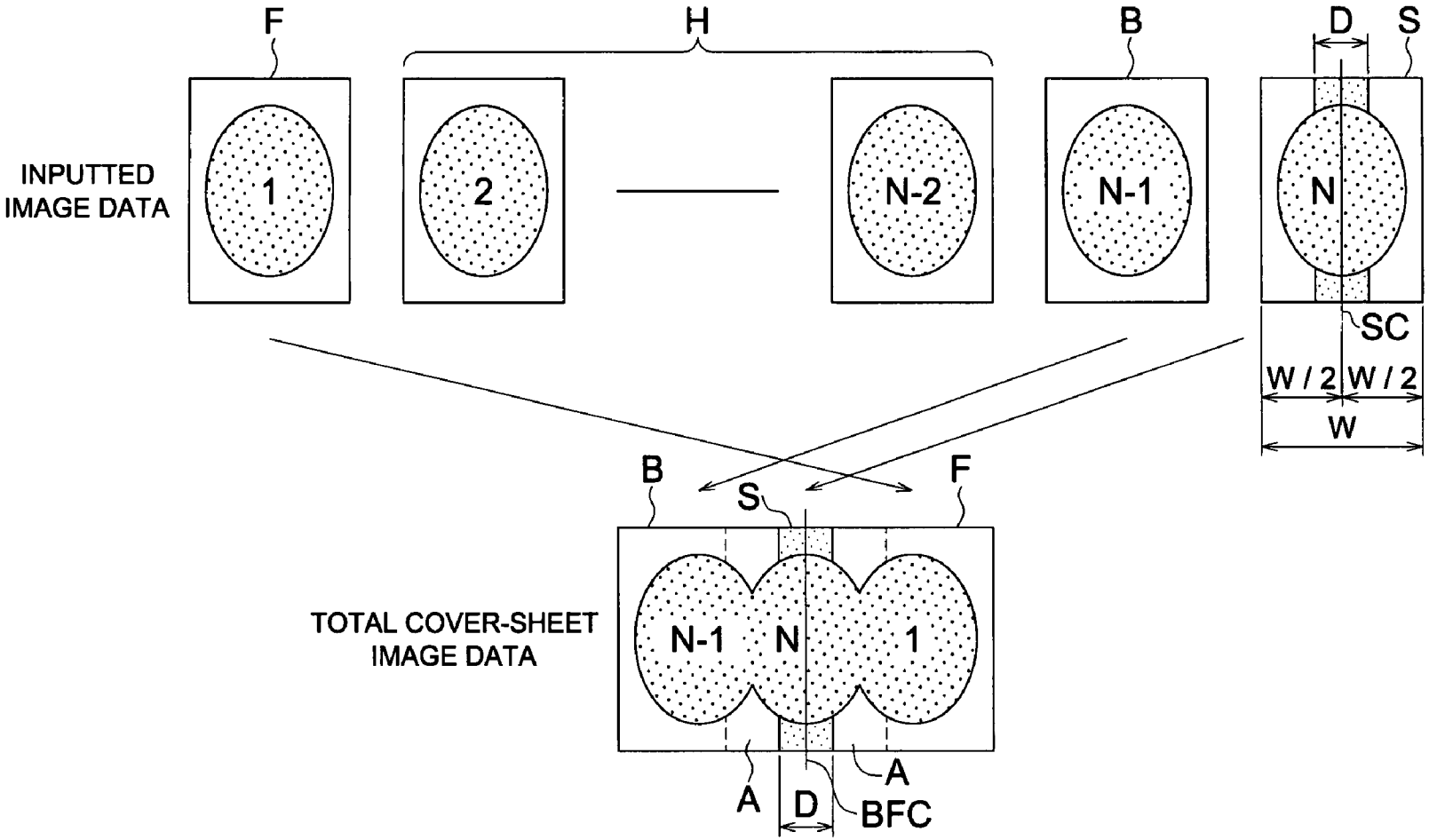
FIG. 4 shows an example of another image forming operation when forming images onto one side surface of a cover sheet.

FIG. 4 shows an example of the other image forming operation when forming images onto one side surface of the cover sheet 2. FIG. 4 is the same as FIG. 3, except that the processing to be applied to the overlapping area A at which the lining cover-sheet image data S overlap the rear cover-sheet image data B or the front cover-sheet image data F is different from that shown in FIG. 3.

In FIG. 4, the image data of the overlapping area A, at which the lining cover-sheet image data S overlap the rear cover-sheet image data B or the front cover-sheet image data F, are derived by conducting the OR-logical calculation between the lining cover-sheet image data S and either the rear cover-sheet image data B or the front cover-sheet image data F.

As mentioned in the foregoing, by disposing the lining cover-sheet image data S at such a position that the central line SC of the lining cover-sheet image data S coincides with the central line BFC of the interval area between the rear cover-sheet image data B and the front cover-sheet image data F, it becomes possible to form the lining cover image at an appropriate position of the lining cover sheet, since the center of the lining cover-sheet image data S is always located at the center of the lining cover, even if the lining cover sheet width would be changed.

Further, by making a part of the lining cover-sheet image data S, corresponding to the overlapping area A at which the lining cover-sheet image data S overlap the rear cover-sheet image data B or the front cover-sheet image data F, invalid, it becomes possible to obtain the total cover-sheet image data shown in FIG. 3. Still further, by conducting the OR-logical calculation between the lining cover-sheet image data S and either the rear cover-sheet image data B or the front cover-sheet image data F, it becomes possible to easily obtain the total cover-sheet image data shown in FIG. 4. Accordingly, it becomes possible to obtain an appropriate cover-sheet image data as needed.

Still further, if the document size of the lining cover sheet is the same as those of the front cover sheet, the main content sheets and the rear cover sheet, it becomes possible to easily set the documents onto the document reading section 15, since it is only required to simply overlap the lining cover sheet onto the other documents.

<Cover Sheet Image Formation Processing>

Figure 5:
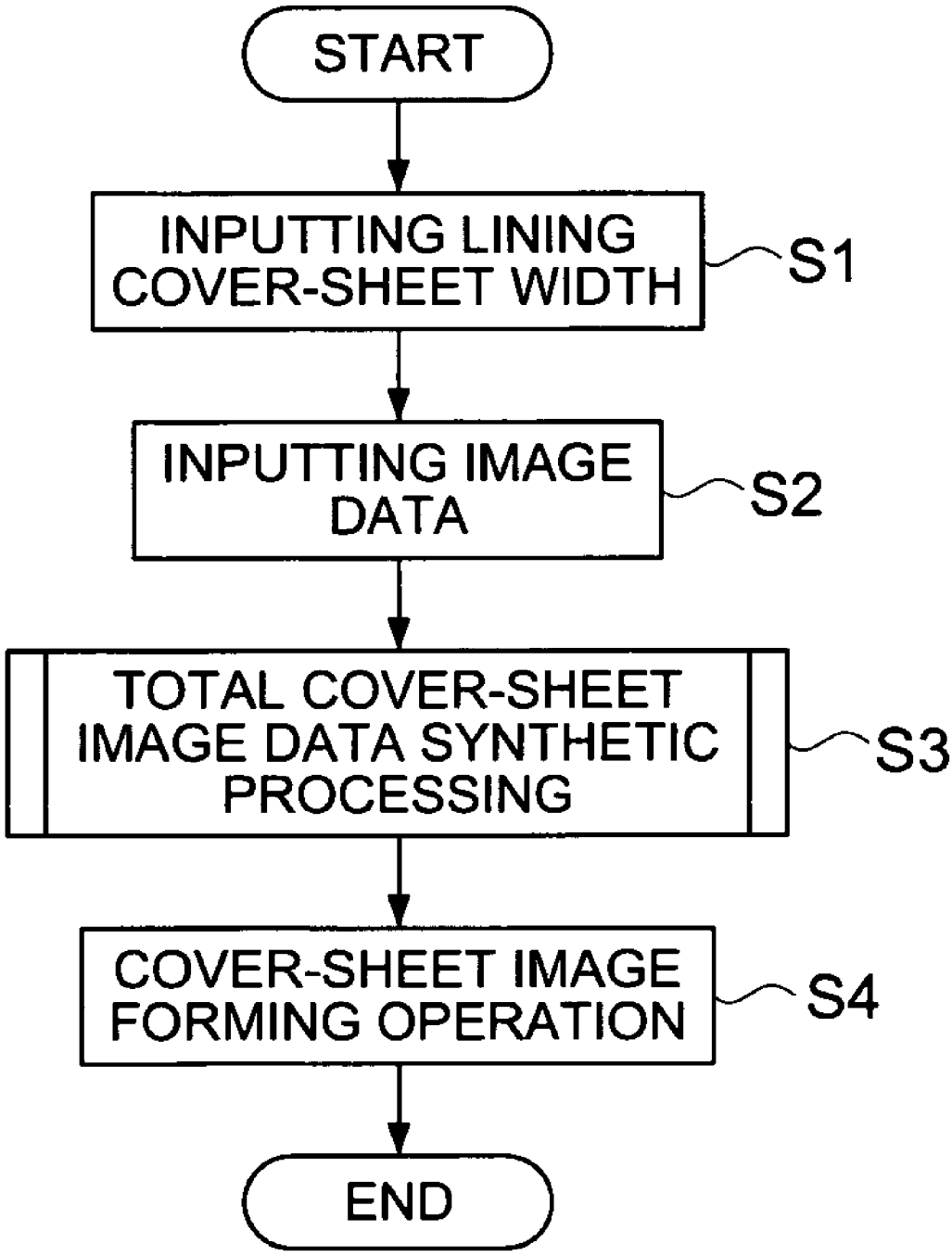
FIG. 5 shows a flowchart of a cover sheet image formation processing embodied in the present invention.

FIG. 5 shows a flowchart of the cover sheet image formation processing embodied in the present invention. The flowchart shown in FIG. 5 is merely an example among various embodiments. Accordingly, the scope of the present invention is not limited to the above. The CPU 11 executes a program stored in the ROM 13 to conduct the cover sheet image formation processing mentioned in the above.

At first, the CPU 11 controls the display section 19 to display the lining cover-sheet width inputting screen. In response to the above, the user inputs the lining sheet width D from the operation section 18 so as to input the lining sheet width D into the CPU 11 (Step S1).

Successively, the user sets the document onto the document reading section 15, and inputs an instruction for commencing the printing operation from the operation section 18. Then, the CPU 11 drives the document reading section 15 so as to input the document images (Step S2). Accordingly, as described by referring to FIG. 3, for instance, the front cover-sheet image data F corresponding to Page 1, the main-content sheets image data H corresponding to Page 2-Page (N-2), the rear cover-sheet image data B corresponding to Page (N-1) and the lining cover-sheet image data S corresponding to Page N are inputted from the document reading section 15, and stored in the RAM 14.

Next, the CPU 11 conducts a synthetic processing for generating the total cover-sheet image data (Step S3). The synthetic processing will be detailed later.

Next, the CPU 11 sends a command to the paper feeding section 16 for feeding a cover sheet accommodated in the paper feeding section 16 to the image forming section 17, and sends another command to the image forming section 17 for conducting the image forming operation so as to form the images based on the total cover-sheet image data synthesized in the Step S3 onto the cover sheet fed into the image forming section 17 (Step S4). Accordingly, the synthesized image based on the total cover-sheet image data is formed on the cover sheet.

<Total Cover-Sheet Image Data Synthetic Processing>

Figure 6:
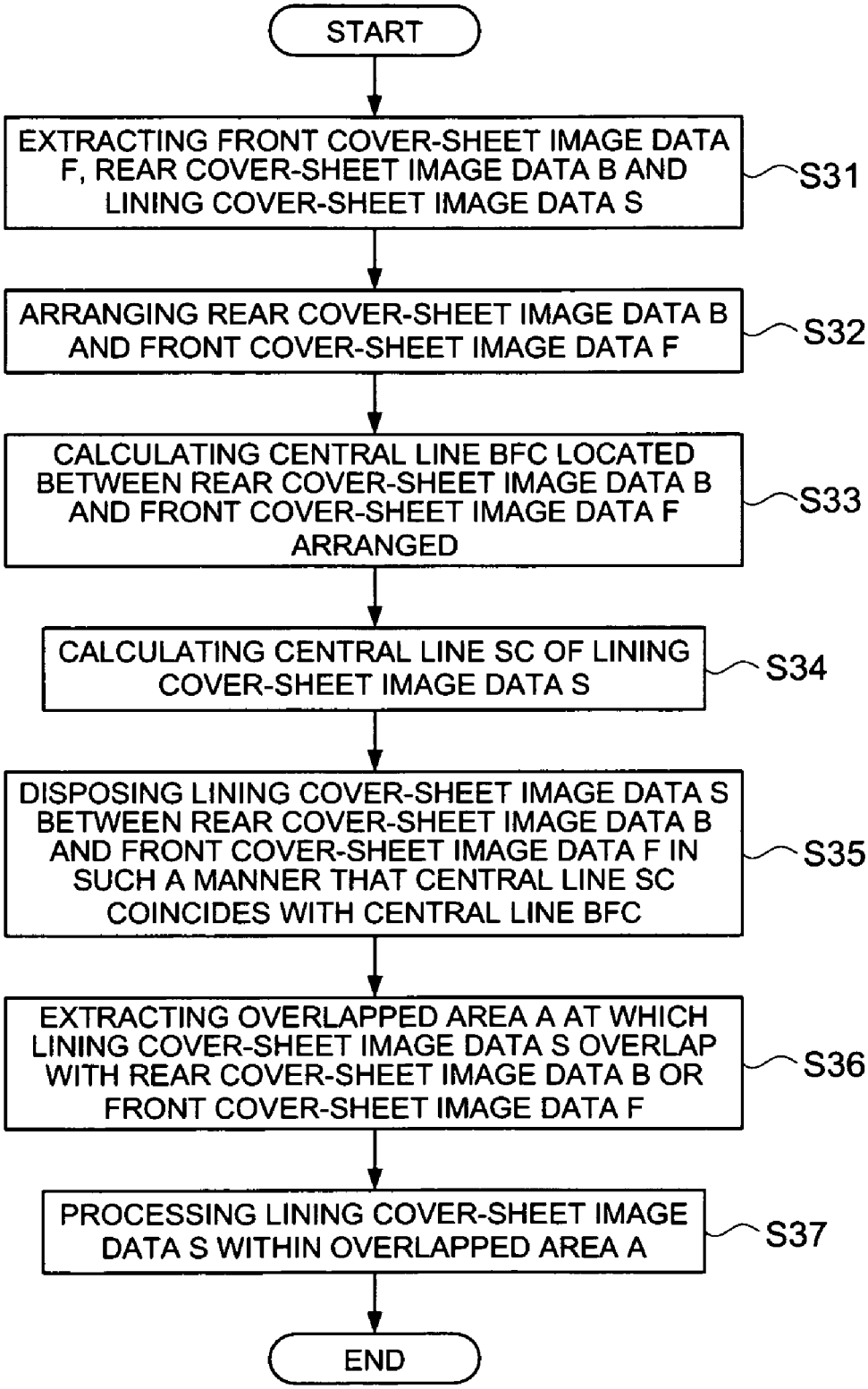
FIG. 6 shows a flowchart of a total cover-sheet image data synthetic processing to be conducted in Step S3 shown in FIG. 5.

FIG. 6 shows a flowchart of the total cover-sheet image data synthetic processing to be conducted in Step S3 shown in FIG. 5. The flowchart shown in FIG. 6 is merely an example among various embodiments. Accordingly, the scope of the present invention is not limited to the above. The CPU 11 executes a program stored in the ROM 13 to conduct the total cover-sheet image data synthetic processing mentioned in the above.

At first, the CPU 11 extracts specific page image data sets to be utilized for forming images onto the cover sheet from the page image data sets inputted in Step S2 shown in FIG. 5. Concretely speaking, the CPU 11 extracts the image data of Page N serving as the final page, the image data of Page 1 and the image data of Page (N-1) as the lining cover-sheet image data S, the front cover-sheet image data F and the rear cover-sheet image data B, respectively (Step S31).

Next, the CPU 11 arranges the rear cover-sheet image data B and the front cover-sheet image data F at an interval of the lining sheet width D inputted in Step S1 shown in FIG. 5 (Step S32).

Further, the CPU 11 calculates a position of the central line BFC in the interval area located between the rear cover-sheet image data B and the front cover-sheet image data F, which are arranged at the interval of the lining sheet width D (Step S33).

Still further, the CPU 11 calculates a width W of the lining cover-sheet image data S, and calculates a position of the central line SC of the lining cover-sheet image data S in width direction (Step S34).

Still further, the CPU 11 attaches the lining cover-sheet image data S to the rear cover-sheet image data B and the front cover-sheet image data F arranged in Step S32. At this time, the lining cover-sheet image data S is disposed at such a position that the central line SC of the lining cover-sheet image data S, calculated in the Step S34, coincides with the central line BFC in the interval area between the rear cover-sheet image data B and the front cover-sheet image data F, which are disposed at the interval of the lining sheet width D (Step S35).

Successively, the CPU 11 extracts the overlapping area A at which the lining cover-sheet image data S overlap with the rear cover-sheet image data B and the front cover-sheet image data F (Step S36).

Further, the CPU 11 conducts the processing of the lining cover-sheet image data S in the overlapping area A (Step S37). In the case of FIG. 3, the CPU 11 deletes the lining cover-sheet image data S concerned, and makes the lining cover-sheet image data S in the overlapping area A invalid. In the case of FIG. 4, the CPU 11 conducts the OR-logical calculation between the lining cover-sheet image data S and either the rear cover-sheet image data B or the front cover-sheet image data F in the overlapping area A. Incidentally, when recognizing the area corresponding to the lining sheet width D in the lining cover-sheet image data S instead of extracting the overlapping area A, in order to extract only the image data other than those in the area corresponding to the lining sheet width D in the lining cover-sheet image data S, Step S36 would be omitted, and the Step S37 would be replaced by such a step that only the image data other than those in the area corresponding to the lining sheet width D in the lining cover-sheet image data S are extracted.

In the embodiment described in the foregoing, the image data are inputted from the document reading section 15. However, it is also applicable that the image data are inputted from external devices, such as a personal computer, etc., through the communication section 20.

Further, in the embodiment described in the foregoing, the rear cover-sheet image data B, the front cover-sheet image data F and the lining cover-sheet image data S are arranged on the basis of the programs installed in advance in the image forming apparatus 10. However, it is also applicable that the image data sets are generated in any one of the external devices, such as a personal computer, etc., and the rear cover-sheet image data B, the front cover-sheet image data F and the lining cover-sheet image data S are arranged on the basis of the programs installed in the external device concerned, such as the printer driver, etc.

According to the present invention, since the center of the lining cover sheet and the center of the lining cover-sheet image data always coincide with each other in the width direction, it becomes possible to form the lining cover sheet image at an appropriate position of the lining cover sheet, even if the lining cover sheet width would be changed.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

a lining cover-sheet width acquiring section to acquire information with respect to a lining cover-sheet width;

a cover-sheet image data acquiring section to acquire front cover-sheet image data, rear cover-sheet image data and lining cover-sheet image data;

a cover-sheet image data arranging section to arrange the front cover-sheet image data and the rear cover-sheet image data, acquired by the cover-sheet image data acquiring section, in such a manner that a front cover sheet image and a rear cover sheet image are arranged at an interval of the lining cover-sheet width, acquired by the lining cover-sheet width acquiring section, and to arrange the lining cover-sheet image data, acquired by the cover-sheet image data acquiring section, in such a manner that a lining image center line, indicating a center position of an image area of a lining cover sheet image in its width direction, coincides with a cover sheet center line, indicating a center position of an image area of a total cover sheet image, including the front cover sheet image, the rear cover sheet image and the lining cover sheet image, in its width direction; and an image forming section to form the total cover sheet image, including the front cover sheet image, the rear cover sheet image and the lining cover sheet image, onto a recording medium, based on the front cover-sheet image data, the rear cover-sheet image data and the lining cover-sheet image data, which are arranged by the cover-sheet image data arranging section.

2. The image forming apparatus of claim 1, further comprising;

a lining image data processing section to apply a predetermined processing to the lining cover-sheet image data;

wherein the cover-sheet image data arranging section arranges the lining cover-sheet image data processed by the lining image data processing section.

3. The image forming apparatus of claim 2, further comprising;

an overlapping area extracting section to extract overlapping areas on which the lining cover-sheet image data overlaps with the front cover-sheet image data and the rear cover-sheet image data, arranged by the cover-sheet image data arranging section;

wherein the lining image data processing section applies the predetermined processing to a part of the lining cover-sheet image data corresponding to the overlapping areas.

4. The image forming apparatus of claim 3, wherein the predetermined processing is to make the part of the lining cover-sheet image data corresponding to the overlapping areas invalid.

5. The image forming apparatus of claim 3, wherein the predetermined processing is to conduct a OR-logical calculation between the part of the lining cover-sheet image data and both a part of the front cover-sheet image data and a part of the rear cover-sheet image data, which correspond to the overlapping areas.

6. The image forming apparatus of claim 2, wherein the predetermined processing is to extract specific lining image data, corresponding to the lining cover-sheet width, from the lining cover-sheet image data.

7. The image forming apparatus of claim 1, wherein a data size of the lining cover-sheet image data are same as those of the front cover-sheet image data and the rear cover-sheet image data.

8. An image forming system, comprising:

an image forming apparatus that includes: a lining cover-sheet width acquiring section to acquire information with respect to a lining cover-sheet width; a cover-sheet image data acquiring section to acquire front cover-sheet image data, rear cover-sheet image data and lining cover-sheet image data; a cover-sheet image data arranging section to arrange the front cover-sheet image data and the rear cover-sheet image data, acquired by the cover-sheet image data acquiring section, in such a manner that a front cover sheet image and a rear cover sheet image are arranged at an interval of the lining cover-sheet width, acquired by the lining cover-sheet width acquiring section, and to arrange the lining cover-sheet image data, acquired by the cover-sheet image data acquiring section, in such a manner that a lining image center line, indicating a center position of an image area of a lining cover sheet image in its width direction, coincides with a cover sheet center line, indicating a center position of an image area of a total cover sheet image, including the front cover sheet image, the rear cover sheet image and the lining cover sheet image, in its width direction; and an image forming section to form the total cover sheet image, including the front cover sheet image, the rear cover sheet image and the lining cover sheet image, onto a recording medium, based on the front cover-sheet image data, the rear cover-sheet image data and the lining cover-sheet image data, which are arranged by the cover-sheet image data arranging section; and a book binding apparatus that joins the recording medium, on which the total cover sheet image is formed by the image forming apparatus, to a plurality of paper sheets, in such a manner that the plurality of paper sheets is enveloped by the recording medium while one side, upper and lower sides of the plurality of paper sheets are made to be open.

9. The image forming system of claim 8, wherein the book binding apparatus joins the recording medium to the plurality of paper sheets by adhering them to each other with adhesive material.

10. A product for storing a computer program, the computer program comprising:

a lining cover-sheet width acquiring step for acquiring information with respect to a lining cover-sheet width;

a cover-sheet image data acquiring step for acquiring front cover-sheet image data, rear cover-sheet image data and lining cover-sheet image data;

a cover-sheet image data arranging step for arranging the front cover-sheet image data and the rear cover-sheet image data, acquired in the cover-sheet image data acquiring step, in such a manner that a front cover sheet image and a rear cover sheet image are arranged at an interval of the lining cover-sheet width, acquired in the lining cover-sheet width acquiring step, and for arranging the lining cover-sheet image data, acquired in the cover-sheet image data acquiring step, in such a manner that a lining image center line, indicating a center position of an image area of a lining cover sheet image in its width direction, coincides with a cover sheet center line, indicating a center position of an image area of a total cover sheet image, including the front cover sheet image, the rear cover sheet image and the lining cover sheet image, in its width direction; and an image forming step for forming the total cover sheet image, including the front cover sheet image, the rear cover sheet image and the lining cover sheet image, onto a recording medium, based on the front cover-sheet image data, the rear cover-sheet image data and the lining cover-sheet image data, which are arranged in the cover-sheet image data arranging step.

11. The product of claim 10, the computer program further comprising;

a lining image data processing step for applying a predetermined processing to the lining cover-sheet image data;

wherein the lining cover-sheet image data, processed in the lining image data processing step, are arranged in the cover-sheet image data arranging step.

12. The product of claim 11, the computer program further comprising;

an overlapping area extracting step for extracting overlapping areas on which the lining cover-sheet image data overlaps with the front cover-sheet image data and the rear cover-sheet image data, arranged in the cover-sheet image data arranging step;

wherein the predetermined processing is applied to a part of the lining cover-sheet image data corresponding to the overlapping areas in the lining image data processing step.

13. The product of claim 12, wherein the predetermined processing is to make the part of the lining cover-sheet image data corresponding to the overlapping areas invalid.

14. The product of claim 12, wherein the predetermined processing is to conduct a OR-logical calculation between the part of the lining cover-sheet image data and both a part of the front cover-sheet image data and a part of the rear cover-sheet image data, which correspond to the overlapping areas.

15. The product of claim 11, wherein the predetermined processing is to extract specific lining image data, corresponding to the lining cover-sheet width, from the lining cover-sheet image data.

16. The product of claim 10, wherein a data size of the lining cover-sheet image data are same as those of the front cover-sheet image data and the rear cover-sheet image data.

* * * * *